US009962059B2

(12) United States Patent
Kramer

(10) Patent No.: US 9,962,059 B2
(45) Date of Patent: May 8, 2018

(54) WAREWASHER WASH ARM FILTER ARRANGEMENT

(71) Applicant: Steven H. Kramer, Osgood, OH (US)

(72) Inventor: Steven H. Kramer, Osgood, OH (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 300 days.

(21) Appl. No.: 14/683,337

(22) Filed: Apr. 10, 2015

(65) Prior Publication Data

US 2015/0320287 A1 Nov. 12, 2015

Related U.S. Application Data

(60) Provisional application No. 61/990,357, filed on May 8, 2014.

(51) Int. Cl.

| | |
|---|---|
| ***A47L 15/24*** | (2006.01) |
| ***B08B 3/14*** | (2006.01) |
| ***A47L 15/42*** | (2006.01) |

(52) U.S. Cl.

CPC ..... *A47L 15/247* (2013.01); *A47L 15/24* (2013.01); *A47L 15/4202* (2013.01); *A47L 15/4278* (2013.01); *B08B 3/14* (2013.01); *A47L 15/4208* (2013.01)

(58) Field of Classification Search

CPC ..... A47L 15/4202; A47L 15/4204; A47L 15/4206; A47L 15/4208; A47L 15/24; A47L 15/241; A47L 15/242; A47L 15/243; A47L 15/245; A47L 15/246; A47L 15/247; A47L 15/4278; A47L 15/4282

See application file for complete search history.

(56) References Cited

U.S. PATENT DOCUMENTS

| | | | | |
|---|---|---|---|---|
| 1,890,520 | A * | 12/1932 | Lindgren | A47L 15/241 134/100.1 |
| 3,563,828 | A * | 2/1971 | Marshall | B01D 46/10 156/228 |
| 5,383,486 | A | 1/1995 | Warner et al. | |
| 5,443,655 | A | 8/1995 | Stover et al. | |
| 5,630,438 | A | 5/1997 | Hoover et al. | |
| 5,794,634 | A | 8/1998 | Noren et al. | |
| 5,850,904 | A | 12/1998 | DeBrosse et al. | |
| 5,927,616 | A | 7/1999 | Grise et al. | |
| 5,996,598 | A | 12/1999 | Watson et al. | |
| 6,006,767 | A | 12/1999 | Hecker et al. | |

(Continued)

FOREIGN PATENT DOCUMENTS

| | | |
|---|---|---|
| DE | 27 02 644 | 7/1978 |
| EP | 0 465 454 | 1/1992 |

(Continued)

OTHER PUBLICATIONS

PCT, International Search Report and Written Opinion of the International Searching Authority, International Application No. PCT/US2015/029029; dated Jul. 17, 2015, 11 pages.

*Primary Examiner* — David G Cormier
(74) *Attorney, Agent, or Firm* — Thompson Hine LLP

(57) ABSTRACT

A warewasher includes a liquid recirculation system for spraying wares with wash liquid from a collecting tank. The warewasher includes a filter arrangement for capturing food debris in a wash spray before the wash spray reaches the wares being cleaned.

14 Claims, 6 Drawing Sheets

(56) References Cited

U.S. PATENT DOCUMENTS

| | | | |
|---|---|---|---|
| 6,170,440 | B1 | 1/2001 | Monnier et al. |
| 6,178,625 | B1 | 1/2001 | Watson et al. |
| 6,510,819 | B1 | 1/2003 | Pollock et al. |
| 6,550,607 | B1 | 4/2003 | Watson et al. |
| 6,612,227 | B2 | 9/2003 | Schroeder et al. |
| 6,918,398 | B2 | 7/2005 | Edelmann et al. |
| 6,964,090 | B2 | 11/2005 | Mathieu et al. |
| RE40,307 | E | 5/2008 | Pollock et al. |
| 7,857,146 | B2 | 12/2010 | Disch et al. |
| 7,892,359 | B2 | 2/2011 | Berner et al. |
| 8,146,612 | B2 | 4/2012 | Brunswick et al. |
| 8,157,924 | B2 | 4/2012 | Warner et al. |
| 8,192,558 | B2 | 6/2012 | Warner |
| 8,215,323 | B2 | 7/2012 | Kramer et al. |
| 8,226,778 | B2 | 7/2012 | Kramer |
| 8,252,121 | B2 | 8/2012 | Brunswick et al. |
| 8,435,358 | B2 | 5/2013 | Disch et al. |
| 8,500,917 | B2 | 8/2013 | Kramer |
| 8,603,259 | B2 | 12/2013 | Berner et al. |
| 8,663,395 | B2 | 3/2014 | Warner et al. |
| 8,679,261 | B2 | 3/2014 | Brunswick et al. |
| 8,746,262 | B2 | 6/2014 | Disch et al. |
| 8,881,750 | B2 | 11/2014 | Braun et al. |
| 2006/0005863 | A1* | 1/2006 | Gurubatham ..... A47L 15/4206 134/58 D |

FOREIGN PATENT DOCUMENTS

| | | |
|---|---|---|
| EP | 1 752 080 | 2/2007 |
| FR | 2 760 624 | 9/1998 |

* cited by examiner

WAREWASHER WASH ARM FILTER ARRANGEMENT

TECHNICAL FIELD

This application relates generally to warewasher systems which are used in commercial applications such as cafeterias and restaurants and, more particularly, to a wash arm filter arrangement useful in such warewash systems.

BACKGROUND

Commercial warewashers commonly include a housing area which defines washing and rinsing zones for dishes, pots pans and other wares. In the pre-wash, wash and post-wash zones of pass through or continuous-type machines, water is typically pumped from a tank through a pump intake, delivered to the wares via a spraying operation and collected in the tank for re-use. A similar recirculation system is used in batch-type machines as well, which include tanks in the form of sumps. In either case, food debris from the ware commonly falls back down into the tank and can be recirculated by the pump and sprayed back onto wares in the zone, resulting in redeposit onto the wares. In continuous machines in particular, the food debris from one load or rack can adversely impact the next load or rack.

It would be desirable to reduce the amount of food debris that is carried from one zone to the next in continuous-type machines and, in particular, to reduce the amount of food debris on the ware as is passes into the final rinse zone. It would also be desirable to more generally reduce redeposit onto wares in either batch-type or continuous-type warewashers.

SUMMARY

A warewasher includes a filter arrangement for capturing food debris in a wash spray before the wash spray reaches wares being cleaned.

In one aspect, a warewasher for washing wares includes a chamber for receiving wares, the chamber having at least one wash zone upstream of a final rinse zone. The wash zone includes a tank for collecting sprayed liquid of the wash zone and a liquid recirculation system for moving liquid from the tank to a spray arrangement of the wash zone. A conveyor moves wares in a conveyance direction through the chamber from the wash zone to the final rinse zone. The spray arrangement of the wash zone includes multiple spray tubes extending across a path of the conveyor, each spray tube including multiple spray nozzles. A last of the spray tubes in the wash zone in the conveyance direction includes an associated external filter arrangement for limiting food debris that exits the spray nozzles from being directed onto wares traveling along the conveyor.

In one implementation, the spray arrangement of the wash zone includes multiple upper spray tubes and multiple lower spray tubes, and the last of the spray tubes in the conveyance direction is an upper spray tube.

In one implementation, the external filter arrangement forms a channel below the last spray tube, the channel including screening structure aligned with the spray nozzles of the last spray tube.

In one implementation, the channel has an upstream edge barrier and a downstream edge barrier, relative to the conveyance direction, to inhibit flow out of the upstream and downstream edges of the channel. One or both ends of the channel are open such that debris captured by the screen material tends to be flushed out of the end or ends of the channel such that the debris drops downward at locations laterally of the conveyor path so as to avoid being dropped onto wares traveling along the conveyor path.

In one implementation, the channel is formed by a bracket structure having multiple windows therethrough and the screening material overlies the windows.

In one implementation, the filter arrangement is self-flushing, so that captured food debris is moved off of the filter arrangement automatically.

In one implementation, the filter arrangement includes a mount structure connected to the last spray tube, a channel bracket incorporating screening material, and at least one latch mechanism connected to the mount structure enabling the channel bracket to be releasably secured to the last spray tube.

In one implementation, at least one additional spray tube in the wash zone includes an associated external filter arrangement.

In another aspect, a warewasher includes a chamber for receiving wares, the chamber having at least one wash zone including a tank for collecting sprayed liquid of the wash zone and a liquid recirculation system for moving liquid from the tank to a spray arrangement of the wash zone. The spray arrangement is formed at least in part by a spray tube having multiple nozzles. The spray tube includes an external filter arrangement for limiting food debris that exits the spray nozzles from being directed onto wares in the chamber.

In one implementation, the spray tube is located above a ware location of the wash zone, and the external filter arrangement forms a channel below the spray tube, the channel including screening structure aligned with the spray nozzles of the spray tube.

In one implementation, the channel has a first edge barrier extending along a spray length of the spray tube and a second edge barrier extending along the spray length of the spray tube, to inhibit flow out of the edges of the channel. One or both ends of the channel are open such that debris captured by the screen material tends to be flushed out of the end or ends of the channel.

In one implementation, the spray tube extends over a ware conveyance path of the warewasher, and the end or ends of the channel are located such that the debris flushed out of the end or ends of the channel drops downward at locations laterally of the conveyance path so as to avoid being dropped onto wares traveling along the conveyance path.

In one implementation, the channel is formed by a bracket structure having multiple windows therethrough and the screening material overlies the windows.

In one implementation, the filter arrangement includes a mount structure connected to the spray tube, a channel bracket incorporating screening material, and at least one latch mechanism connected to the mount structure enabling the channel bracket to be releasably secured to the spray tube.

In another aspect, a method is provided for washing wares in a conveyor-type warewasher having at least one wash zone for spraying wash liquid onto wares traveling along a conveyor path in a conveyance direction from the wash zone to a downstream rinse zone. The method involves: recirculating wash liquid from a collection tank of the wash zone to spray nozzles of the wash zone for spraying onto wares in the wash zone, wherein the spray nozzles are arranged in multiple sets located at different locations along the conveyor path; and utilizing a filter arrangement in connection with at least a last set of the spray nozzles in the conveyance direction such that at least some food debris emitted by the last set of spray nozzles is captured prior to the spray from the last set of spray nozzles impinging upon the wares.

In one implementation of the method, the filter arrangement and the last set of the spray nozzles are located above the conveyor path; and the method includes directing the captured food debris to one or more locations on lateral sides of the conveyor path such that the food debris dropping downward from the one or more locations does not fall onto wares traveling along the conveyor path.

In one implementation of the method, the filter arrangement forms a channel below the last set of spray nozzles, the channel including screening structure aligned with each of the spray nozzles of the last set of spray nozzles.

In one implementation of the method, the channel has an upstream edge barrier and a downstream edge barrier, relative to the conveyance direction, to inhibit flow out of the upstream and downstream edges of the channel. One or both ends of the channel are open such that debris captured by the screen material tends to be flushed out of the end or ends of the channel such that the debris drops downward at locations laterally of the conveyor path so as to avoid being dropped onto wares traveling along the conveyor path.

In one implementation of the method, the last set of spray nozzles is located on a spray tube, and the bracket structure is releasably secured to the spray tube by at least one latch mechanism.

The details of one or more embodiments are set forth in the accompanying drawings and the description below. Other features, objects, and advantages will be apparent from the description and drawings, and from the claims.

DETAILED DESCRIPTION

Figure 1:
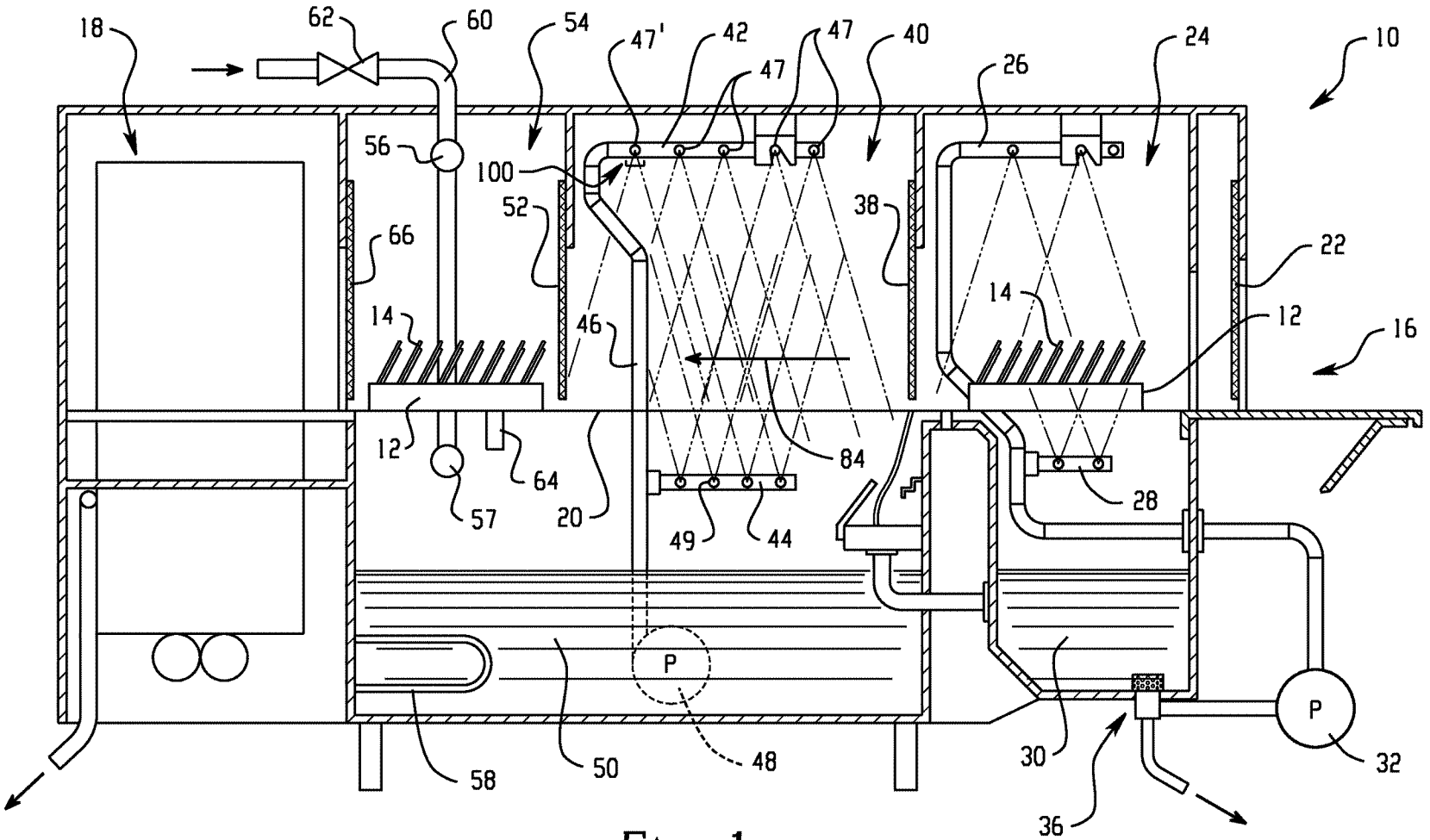
FIG. 1 is a schematic elevation of one embodiment of a warewasher.

Referring to FIG. 1, an exemplary conveyor-type warewash system, generally designated 10, is shown. Warewash system 10 can receive racks 12 of soiled wares 14 from an input side 16 which are moved through tunnel-like chambers from the input side toward a dryer unit 18 (optional) at an opposite end of the warewash system by a suitable conveyor mechanism 20. Either continuously or intermittently moving conveyor mechanisms or combinations thereof may be used, depending, for example, on the style, model and size of the warewash system 10. Flight-type conveyors in which racks are not used are also possible. In the illustrated example, the racks 12 of soiled wares 14 enter the warewash system 10 through a flexible curtain 22 into a pre-wash chamber or zone 24 where sprays of liquid from upper and lower pre-wash manifolds 26 and 28 that feed spray tubes (also known as spray arms) above and below the racks, respectively, function to flush heavier soil from the wares. The liquid for this purpose comes from a tank 30 via a pump 32 and supply conduit 34. A drain system 36 provides a single location where liquid is pumped from the tank 30 using the pump 32. Liquid can be drained from the tank via drain path 36, for example, for a tank cleaning operation.

The racks proceed to a next curtain 38 into a main wash chamber or zone 40, where the wares are subject to sprays of cleansing liquid from upper and lower spray systems in which manifolds 42 and 44 feed lateral spray tubes 47 and 49 with associated nozzles along the lengths of the spray tubes. The manifolds are supplied through a supply conduit 46 by a pump 48, which draws from a main tank 50. A heater 58, such as an electrical immersion heater provided with suitable thermostatic controls (not shown), maintains the temperature of the cleansing liquid in the tank 50 at a suitable level. Not shown, but which may be included, is a device for adding a cleansing detergent to the liquid in tank 50. During normal operation, pumps 32 and 48 are continuously driven, usually by separate motors, once the warewash system 10 is started for a period of time.

The warewash system 10 may optionally include a power rinse (also known as post-wash) chamber or zone (not shown) that is substantially identical to main wash chamber 40. In such an instance, racks of wares proceed from the wash chamber 40 into the power rinse chamber, within which heated rinse water is sprayed onto the wares from upper and lower manifolds.

The racks 12 of wares 14 exit the main wash chamber 40 through a curtain 52 into a final rinse chamber or zone 54. The final rinse chamber 54 is provided with upper and lower spray heads 56, 57 that are supplied with a flow of fresh hot water via pipe 60 under the control of solenoid valve 62. A rack detector 64 is actuated when rack 12 of wares 14 is positioned in the final rinse chamber 54 and through suitable electrical controls, the detector causes actuation of the solenoid valve 62 to open and admit the hot rinse water to the spray heads 56, 57. The water then drains from the wares into tank 50. The rinsed rack 12 of wares 14 then exits the final rinse chamber 54 through curtain 66, moving into dryer unit 18.

As seen in FIG. 1, an exemplary wash arm filter arrangement 100 may be associated with one or more of the spray tubes in one or more of the pre-wash, wash and/or post-wash/power rinse zones. Notably, multiple upper spray tubes 47 and lower spray tubes 49 are located along the conveyor path, each having respective spray nozzles. As noted above, wash water is recirculated from a tank to the spray tubes via a pump. A last of the spray tubes in the conveyance direction 84, here designated as spray tube 47', includes an associated external filter arrangement 100 for limiting food debris that exits the spray nozzles from being directed onto wares traveling along the conveyor 20.

Figure 3:
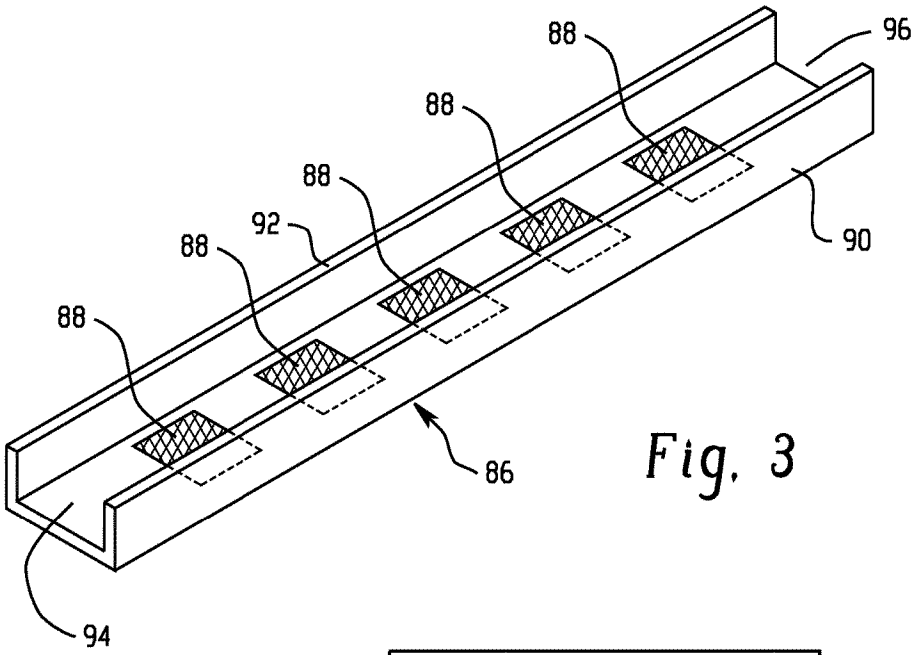
FIG. 3 is a perspective view of one embodiment of a bracket structure of the filter arrangement.
Figure 4:
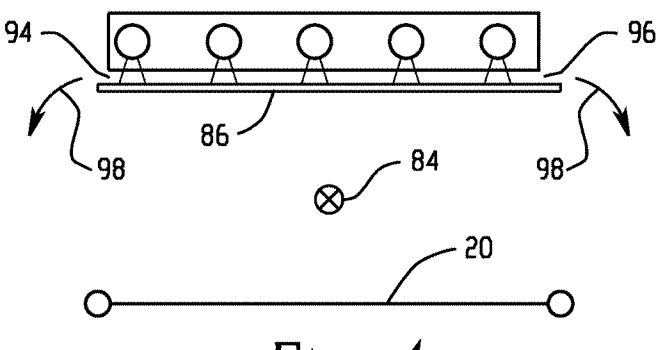
FIG. 4 is a partial end view of the filter arrangement.
Figure 2:
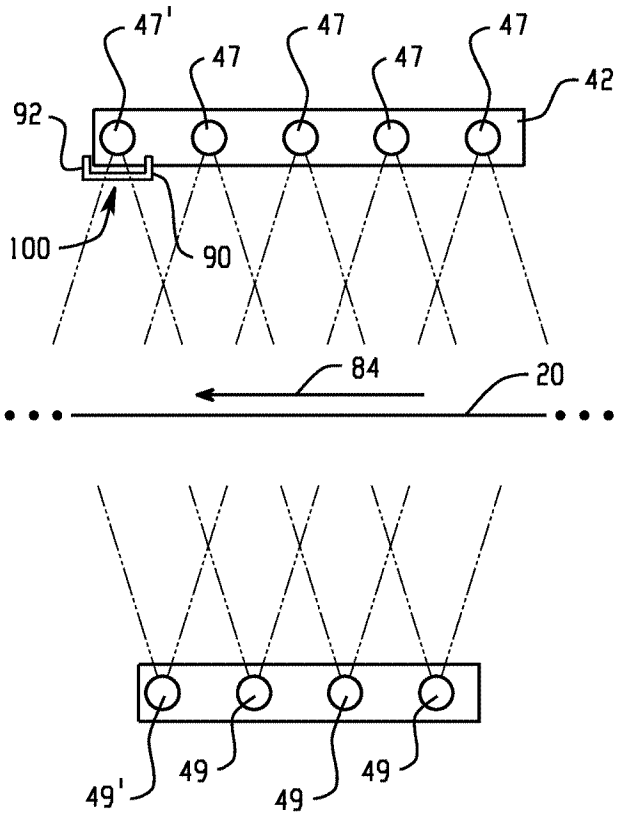
FIG. 2 is a partial schematic view of a filter arrangement of the warewasher.
Figure 5:
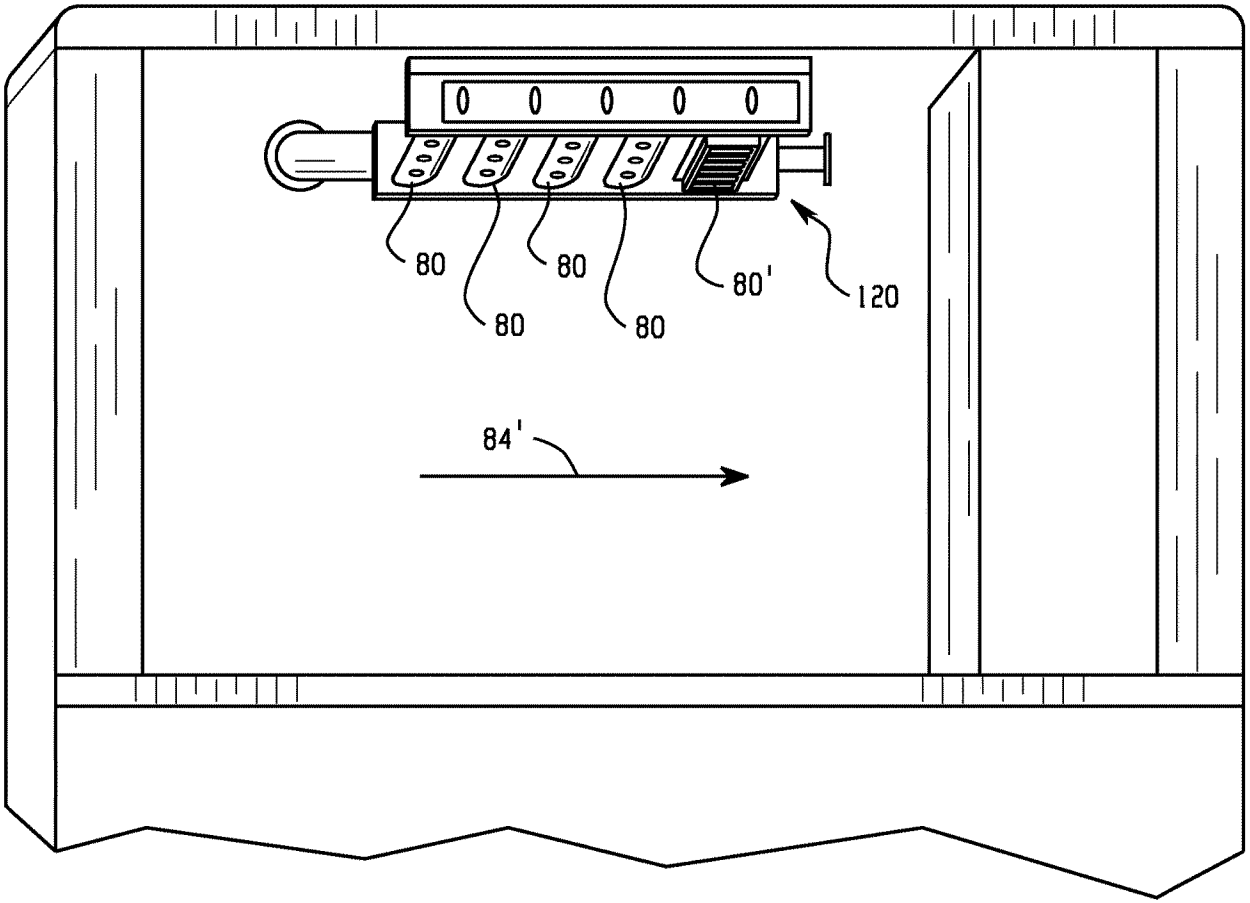
FIG. 5 is a partial perspective view of another embodiment of a filter arrangement in a wash zone.
Figure 7:
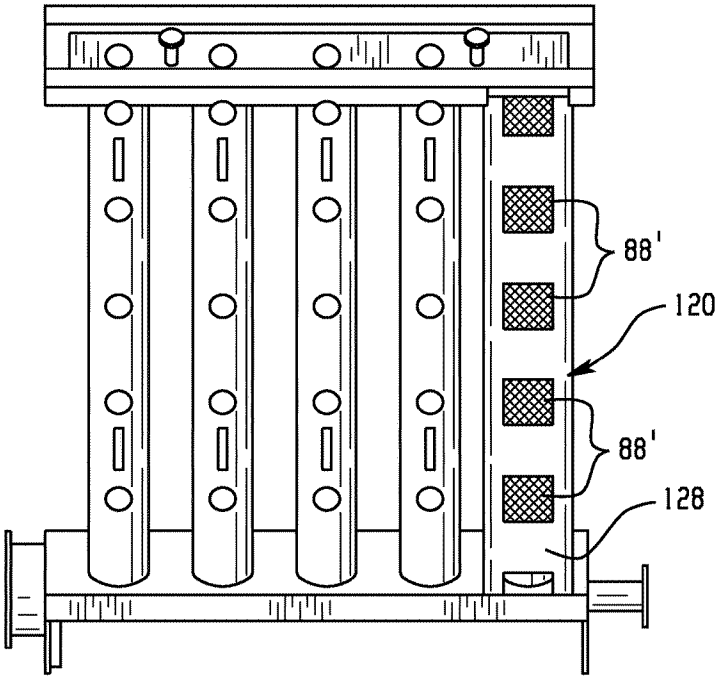
FIG. 7 is a partial perspective view showing the filter arrangement.
Figure 6:
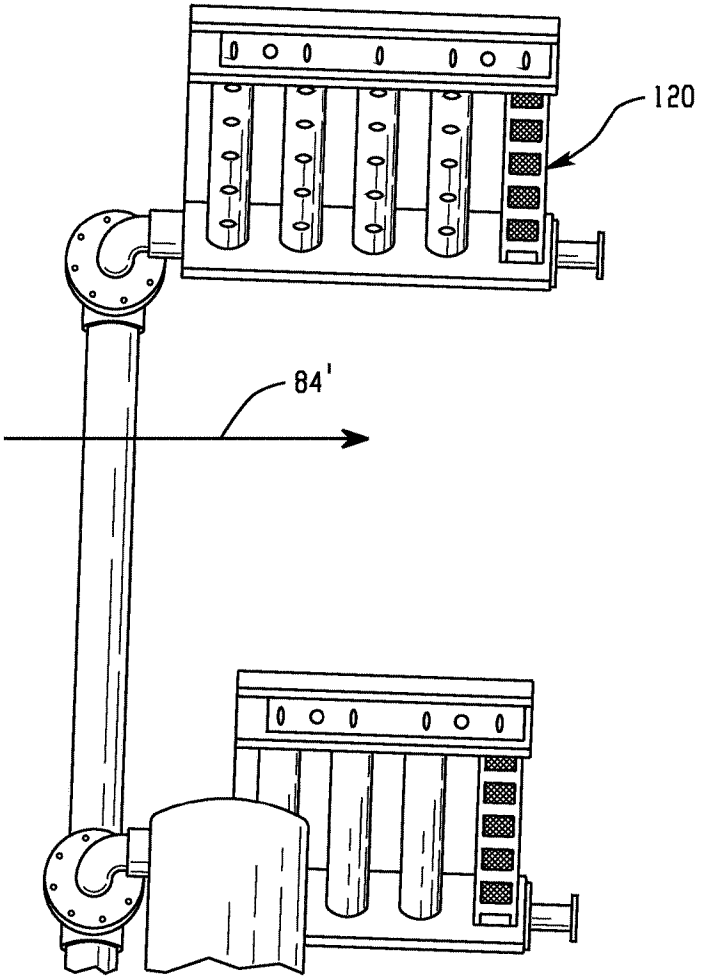
FIG. 6 is a partial perspective view showing the filter arrangement.

As seen in FIGS. 2 and 3, the filter arrangement 100 forms a channel below the last spray tube 47', and the channel includes screening material 88 aligned with the spray nozzles of the last spray tube. In the illustrated embodiment, the channel has an upstream edge with barrier 90 and a downstream edge with barrier 92, relative to the conveyance direction 84, to inhibit flow out of the upstream and downstream edges of the channel. One or both ends 94, 96 of the channel are open such that debris captured by the screen material 88 tends to be flushed out of the end or ends of the channel, such that the debris drops downward at locations laterally of the conveyor path (as suggested by arrows 98 in the schematic end view of FIG. 4) so as to avoid being dropped onto wares traveling along the conveyor path 20. Notably, the filter arrangement therefore provides a self-cleaning or self-flushing feature that reduces the need to remove and clean the filter member.

In the illustrated embodiment, the channel is formed by a bracket structure 86 having multiple windows (e.g. holes) therethrough and the screening material 88 overlies the windows. However, other arrangements could be used, including an arrangement in which the entire channel is formed by screening material. In addition, although a rectangular bracket structure forming the channel is shown, a round structure that surrounds the spray tube could also be used to form the filter arrangement. Moreover, other spray tubes could include a similar external filter arrangement, such as the last two spray arms in the conveyance direction the last upper and lower spray arms in the conveyance direction.

As mentioned above, the subject filter arrangement may be used in any of the wash zones. However, in the most effective arrangement the filter arrangement is provided at least in the wash zone that is immediately upstream of the final rinse section of the machine. In this manner, the last water that is sprayed onto the wares before the rinse section is largely free of significant food debris, reducing redeposit and making it easier for the final rinse section to achieve desired results. Notably, the external filter arrangement allows food debris to exits the spray nozzles before capturing it, so that the external filter arrangement does not result in build-up of food debris within the spray tube.

Testing has shown the ability to reduce food debris particulates per rack of wares entering the rinse section by over fifty percent as compared to the same machine without the filter arrangement. In some cases this result will reduce the amount of rinse water that will be required to be sprayed in the final rinse, thereby reducing overall machine operating cost.

Figure 8:
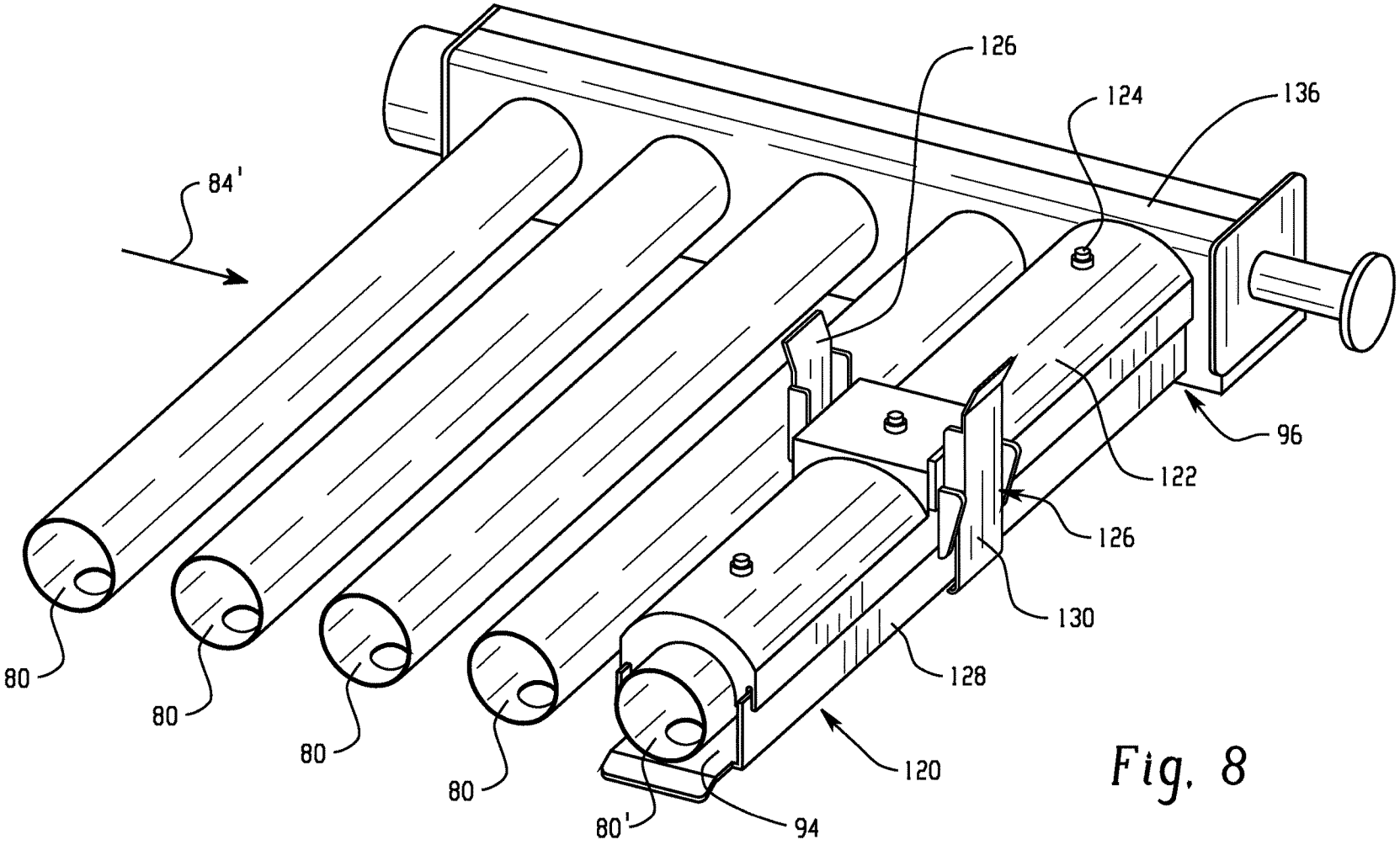
FIG. 8 is a partial perspective view showing the filter arrangement.
Figure 9:
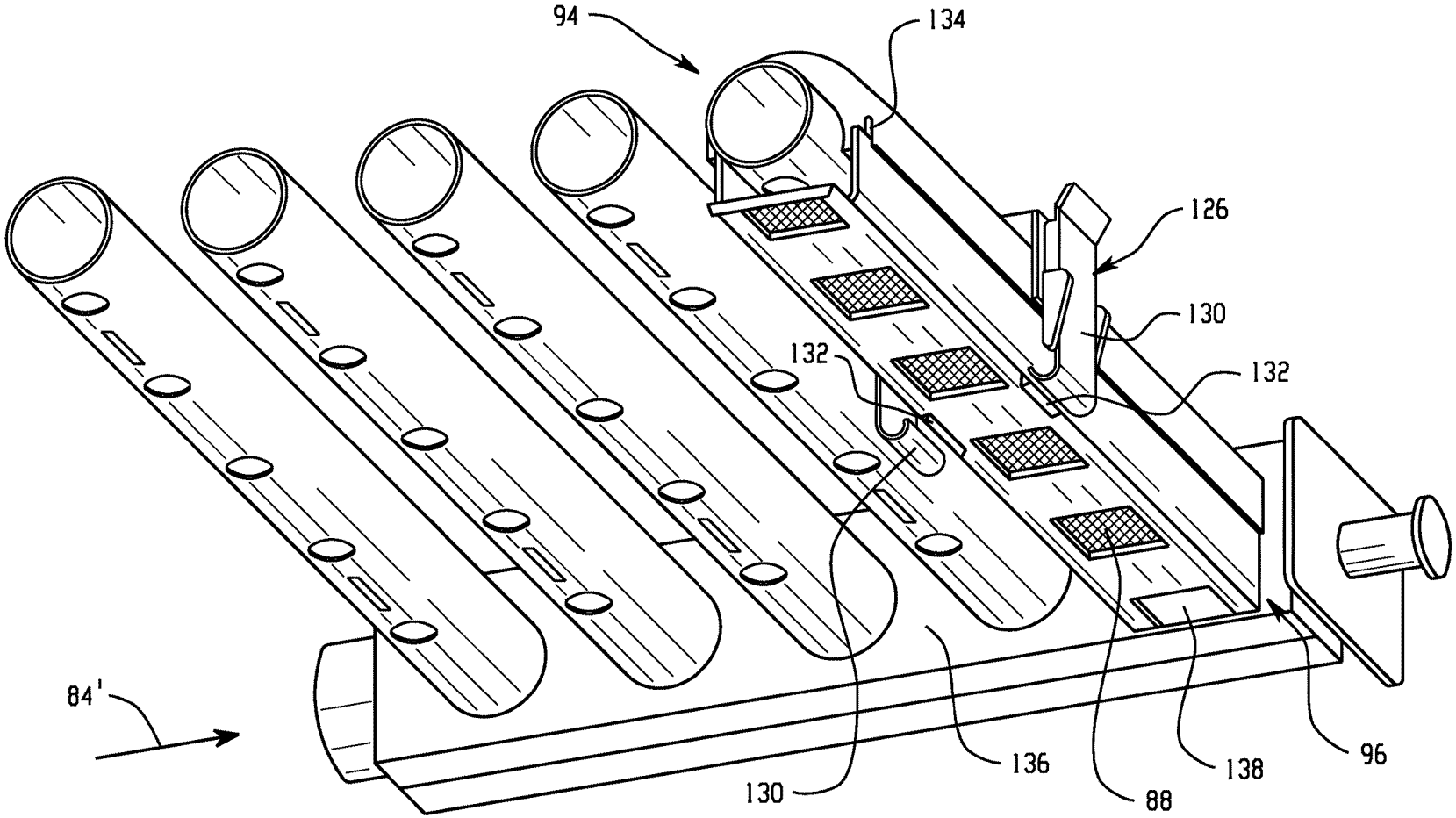
FIG. 9 is a partial perspective view showing the filter arrangement.

FIGS. 5-9 show other depictions in which the conveyance direction 84' relative to multiple spray tubes 80 (as shown on the page) is generally opposite that shown for FIGS. 1-4. As best seen in FIGS. 8 and 9, the filter arrangement 120 may be coupled to the last spray tube 80' utilizing a clamp arrangement that includes an upper housing member 122 that may be fixedly attached to the spray tube 80' (e.g., by one or more fasteners 124) and two which latch mechanisms 126 are mounted. The latch mechanisms interact with the channel bracket 128 of the filter structure (e.g., by downwardly extending fingers 130 of the latch that engage with the underside of the bracket 128 and/or with small flanges 132 that extend downward from the bracket). The latch mechanisms (e.g., which may be of the over center type) may be released to enable the bracket 128 to be removed for cleaning.

Notably, in the illustrated embodiment, the upper edges of the channel bracket 128 engage with lower edges of the housing member 122 (e.g., in simple abutment or by slight insertion into downward facing recesses 134) to assure that any liquid/debris flow that does not pass through the screening material is forced towards the ends of the channel bracket. End 94 is of the channel bracket 128 is open to allow the debris to flush outwardly as mentioned above, and end 96 abuts against the manifold bracket 136, but includes a downwardly facing open (i.e., unscreened) window 138 for the same purpose. The underside of the housing member 122 may sit flushly against the outer surface of the tube 80' to assure that no food debris can move upward between the housing member and the tube 80'. The channel bracket 128 includes screened openings 88' that align with the spray nozzles of the tube 80', similar to bracket 86 above.

It is to be clearly understood that the above description is intended by way of illustration and example only and is not intended to be taken by way of limitation, and that changes and modifications are possible. Accordingly, other embodiments are contemplated and modifications and changes could be made without departing from the scope of this application. For example, although a conveyor-type machine is shown in FIG. 1, the wash arm filter arrangement could be implemented on other machines. Warewash machines are categorized into two types based on the operating modes (i.e., batch or continuous) and the wash arm filter arrangement could be used on spray tubes of both machine types.

What is claimed is:

1. A warewasher for washing wares, comprising:

a chamber for receiving wares, the chamber having at least one wash zone upstream of a final rinse zone, the wash zone including a tank for collecting sprayed liquid of the wash zone and a liquid recirculation system for moving liquid from the tank to a spray arrangement of the wash zone;

a conveyor for moving wares in a conveyance direction through the chamber from the wash zone to the final rinse zone;

wherein the spray arrangement of the wash zone comprises multiple spray tubes extending across a path of the conveyor, each spray tube including multiple spray nozzles, wherein a last of the spray tubes in the wash zone in the conveyance direction includes an associated filter arrangement for limiting food debris that exits the spray nozzles from being directed onto wares traveling along the conveyor, wherein the filter arrangement is external of the last spray tube such that sprays exiting the spray nozzles of the last spray tube must pass through the filter arrangement to reach wares traveling along the conveyor, wherein the spray arrangement of the wash zone includes multiple upper spray tubes and multiple lower spray tubes, and the last of the spray tubes in the conveyance direction is an upper spray tube.

2. The warewasher of claim 1 wherein the filter arrangement forms a channel below the last spray tube, the channel including screening structure aligned with the spray nozzles of the last spray tube.

3. The warewasher of claim 2 wherein the channel has an upstream edge barrier and a downstream edge barrier, relative to the conveyance direction, to inhibit flow out of the upstream and downstream edges of the channel, wherein the channel includes at least one end that is open such that debris captured by the screen material tends to be flushed out of the at least one end of the channel such that the debris drops downward at a location lateral of the conveyor path so as to avoid being dropped onto wares traveling along the conveyor path.

4. The warewasher of claim 2 wherein the channel is formed by a bracket structure having multiple windows therethrough and the screening material overlies the windows.

5. The warewasher of claim 1 wherein the filter arrangement is self-flushing, so that captured food debris is moved off of the filter arrangement automatically.

6. The warewasher of claim 1 wherein at least one other spray tube of the spray tubes in the wash zone, in addition to the last spray tube, includes an associated filter arrangement.

7. A warewasher for washing wares, comprising:

a chamber for receiving wares, the chamber having at least one wash zone upstream of a final rinse zone, the wash zone including a tank for collecting sprayed liquid of the wash zone and a liquid recirculation system for moving liquid from the tank to a spray arrangement of the wash zone;

a conveyor for moving wares in a conveyance direction through the chamber from the wash zone to the final rinse zone;

wherein the spray arrangement of the wash zone comprises multiple spray tubes extending across a path of the conveyor, each spray tube including multiple spray nozzles, wherein a last of the spray tubes in the wash zone in the conveyance direction includes an associated filter arrangement for limiting food debris that exits the spray nozzles from being directed onto wares traveling along the conveyor, wherein the filter arrangement is external of the last spray tube such that sprays exiting the spray nozzles of the last spray tube must pass through the filter arrangement to reach wares traveling along the conveyor;

wherein the filter arrangement includes a mount structure connected to the last spray tube, a channel bracket incorporating screening material, and at least one latch mechanism connected to the mount structure enabling the channel bracket to be releasably secured to the last spray tube.

8. A warewasher for washing wares, comprising:

a chamber for receiving wares, the chamber having at least one wash zone including a tank for collecting sprayed liquid of the wash zone and a liquid recirculation system for moving liquid from the tank to a spray arrangement of the wash zone, the spray arrangement formed at least in part by a spray tube having multiple nozzles, the spray tube including a filter arrangement external of the spray tube and positioned so that sprays exiting the multiple nozzles pass through the filter arrangement before reaching wares in the chamber for limiting food debris that exits the spray nozzles from being directed onto wares in the chamber;

wherein the spray tube is located above a ware location of the wash zone, and the filter arrangement forms a channel below the spray tube, the channel including screening structure aligned with the spray nozzles of the spray tube.

9. The warewasher of claim 8 wherein the channel has a first edge barrier extending along a spray length of the spray tube and a second edge barrier extending along the spray length of the spray tube, to inhibit flow out of the edges of the channel, wherein the channel includes opposite ends that are open such that debris captured by the screen material tends to be flushed out of the opposite ends of the channel.

10. The warewasher of claim 9 wherein the spray tube extends over a ware conveyance path of the warewasher, and the opposite ends of the channel are located such that the debris flushed out of the opposite ends of the channel drops downward at locations laterally of the conveyance path so as to avoid being dropped onto wares traveling along the conveyance path.

11. The warewasher of claim 8 wherein the channel is formed by a bracket structure having multiple windows therethrough and the screening material overlies the windows.

12. A warewasher for washing wares, comprising:

a chamber for receiving wares, the chamber having at least one wash zone including a tank for collecting sprayed liquid of the wash zone and a liquid recirculation system for moving liquid from the tank to a spray arrangement of the wash zone, the spray arrangement formed at least in part by a spray tube having multiple nozzles, the spray tube including a filter arrangement external of the spray tube and positioned so that sprays exiting the multiple nozzles pass through the filter arrangement before reaching wares in the chamber for limiting food debris that exits the spray nozzles from being directed onto wares in the chamber;

wherein the filter arrangement includes a mount structure connected to the spray tube, a channel bracket incorporating screening material, and at least one latch mechanism connected to the mount structure enabling the channel bracket to be releasably secured to the spray tube.

13. A warewasher for washing wares, comprising:

a chamber for receiving wares, the chamber having at least one wash zone including a tank for collecting sprayed liquid of the wash zone and a liquid recirculation system for moving liquid from the tank to a spray arrangement of the wash zone, the spray arrangement formed at least in part by a spray tube having at least one spray nozzle, a filter arrangement mounted to the spray tube and positioned so that a spray exiting the at least one nozzle passes through the filter arrangement before reaching wares in the chamber for limiting food debris that exits the at least one spray nozzle from being directed onto wares in the chamber.

14. The warewasher of claim 13 wherein the filter arrangement is mounted to the spray tube by a releasable latch assembly that enables removal of the filter arrangement from the spray tube.

* * * * *